US007976640B2

(12) United States Patent
Meyer et al.

(10) Patent No.: US 7,976,640 B2
(45) Date of Patent: Jul. 12, 2011

(54) ON-LINE HEAT EXCHANGER CLEANING METHOD

(75) Inventors: Douglas S. Meyer, Fromberg, MT (US); Glen B. Brons, Baytown, TX (US); Ryan E. Vick, Pearland, TX (US); Douglas P. Bryant, Seabrook, TX (US); Gary L. Novosad, Baytown, TX (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 0 days.

(21) Appl. No.: 11/391,258

(22) Filed: Mar. 29, 2006

(65) Prior Publication Data

US 2006/0219266 A1 Oct. 5, 2006

Related U.S. Application Data

(60) Provisional application No. 60/668,147, filed on Apr. 4, 2005.

(51) Int. Cl.
*B04B 9/00* (2006.01)

(52) U.S. Cl. ... 134/22.1; 134/19; 134/22.11; 134/22.12; 134/22.14; 134/22.18; 134/22.19; 134/34; 134/36; 134/40; 134/42

(58) Field of Classification Search ..... 134/19, 134/22.1, 22.11, 22.12, 22.14, 22.18, 22.19, 134/34, 36, 40, 42
See application file for complete search history.

(56) References Cited

U.S. PATENT DOCUMENTS

| | | | | | |
|---|---|---|---|---|---|
| 2,970,958 | A | | 2/1961 | Shapiro | |
| 3,850,741 | A | * | 11/1974 | Callahan et al. | 208/48 R |
| 4,108,681 | A | * | 8/1978 | Lawson et al. | 134/20 |
| 4,515,685 | A | * | 5/1985 | Yeh | 208/309 |
| 4,925,497 | A | | 5/1990 | Thierheimer, Jr. | |
| 5,225,002 | A | | 7/1993 | Stafford et al. | |
| 5,273,591 | A | | 12/1993 | Perkins | |
| 5,382,728 | A | * | 1/1995 | Del Bianco et al. | 585/24 |
| 5,425,422 | A | | 6/1995 | Jamaluddin et al. | |
| 5,690,176 | A | * | 11/1997 | Delbianco et al. | 166/304 |
| 5,871,634 | A | * | 2/1999 | Wiehe et al. | 208/48 R |
| 5,997,723 | A | * | 12/1999 | Wiehe et al. | 208/48 R |
| 6,187,109 | B1 | | 2/2001 | Park et al. | |
| 6,283,133 | B1 | * | 9/2001 | Furuta et al. | 134/22.14 |
| 6,355,159 | B1 | | 3/2002 | Myers | |
| 6,485,578 | B1 | | 11/2002 | Park et al. | |
| 6,936,112 | B2 | * | 8/2005 | Jansen et al. | 134/19 |
| 2002/0153279 | A1 | * | 10/2002 | Kim et al. | 208/13 |
| 2003/0037807 | A1 | | 2/2003 | Kawakami et al. | |
| 2004/0072361 | A1 | * | 4/2004 | Varadaraj et al. | 436/142 |
| 2004/0121472 | A1 | | 6/2004 | Nemana | |
| 2005/0139238 | A1 | * | 6/2005 | Ferrara | 134/22.11 |
| 2006/0042661 | A1 | * | 3/2006 | Meyer et al. | 134/22.14 |

FOREIGN PATENT DOCUMENTS

| | | | | |
|---|---|---|---|---|
| EP | 0 737 798 | A2 | | 10/1996 |
| JP | 03-007893 | | * | 1/1991 |
| JP | 03007893 | A | * | 1/1991 |
| WO | WO 98/31917 | | | 7/1998 |
| WO | WO 03/103863 | A1 | | 12/2003 |
| WO | WO 2004/037965 | A1 | | 5/2004 |

OTHER PUBLICATIONS

International Search Report, PCT/US2006/012166, dated Oct. 10, 2006.

The Oil Compatibility Model and Crude Oil Incompatibility, Wiehe and Kennedy, Energy & Fuels 2000, vol. 14, pp. 56-59, published Dec. 14, 1999.

* cited by examiner

*Primary Examiner* — Sharidan Carrillo
(74) *Attorney, Agent, or Firm* — Glenn T. Barrett

(57) ABSTRACT

A method for the on-line cleaning of a heat exchanger used with petroleum process fluids which create coke deposits of asphaltenic origin on the exchanger tubes. The asphaltenes are removed by re-dissolution in a solvent oil of high solubility power for the asphaltenes. Certain asphaltenic crudes are useful as solvents in view of their chemical similarity to the asphaltene coke precursors; also useful are refined petroleum fractions such as gas oils which are also characterized by their solvency for asphaltenes. The solvent oil may be admitted to the heat exchanger following withdrawal of the process fluid and then allowed to soak and dissolve the asphaltene coke precursors after which the resulting solution may be withdrawn and the exchanger returned to use without being at any time disconnected from its associated process unit.

12 Claims, No Drawings

ON-LINE HEAT EXCHANGER CLEANING METHOD

CROSS REFERENCE TO RELATED APPLICATION

This invention relates and claims priority to U.S. Provisional Patent Application No. 60/668,147, filed on Apr. 4, 2005, entitled "On-Line Heat Exchanger Cleaning Method.

FIELD OF THE INVENTION

This invention relates to a method for cleaning heat exchangers and more especially, to cleaning heat exchangers without the necessity of removing the exchanger from its associated process unit: cleaning of the exchanger is carried out while it is still on-line in the unit.

BACKGROUND OF THE INVENTION

Heat exchangers transfer heat energy from one fluid (liquid or gas) to another without permitting the two fluids to come into direct contact with one another. There are three main types of heat exchangers, defined by their construction or body types: shell and tube, plate, and air-cooled. Shell and tube (or tubular) heat exchangers are used in applications where high temperature and pressure demands are significant and are the type most commonly encountered in petroleum refineries and petrochemical plants, largely because of their ability to meet the severe service requirements. Tubular heat exchangers are also employed when fluid contains particles that would block the channels of a plate heat exchanger.

Plate heat exchangers are often used for service with low viscosity fluids, including liquid-to-gas heat exchange. Usually, the service requirements impose only moderate demands in terms of operating temperatures and pressures. There are several types of plate heat exchangers including gasketed, brazed, welded and semi-weld or hybrid types. Semi-welded or hybrid type plate exchangers also exist, with plates that are welded together in pairs to allow one fluid to flow in a channel formed by a pair of plates which are welded together with the other fluid passing in a gasketed channel between the welded pair.

Air-cooled heat exchangers have an integral powered fan for cooling the fluid passing through the exchanger, as in an automobile radiator.

As noted above, the shell and tube type exchanger is commonly encountered in petroleum refinery and chemical plant service because of its ability to meet severe service specifications, especially in terms of temperature and pressure. There are several types of shell and tube heat exchangers including U-tube, straight and spiral designs. The U-tube design consists of tubes bent into a U-shape bundle which is fitted with a header to direct the fluid into the tube bundle; supports or flow baffles may be used to direct the fluid flow around the outside the tubes. The straight-tube design with opposed header assemblies is favored when heavy fouling is likely to be encountered in operation: the head assemblies can be removed and the straight line tubes can be mechanically cleaned.

Petroleum refineries and petrochemical plants suffer high operating costs from lost heat transfer efficiency, energy reduction, and cleaning as a result of fouling that occurs during the thermal processing of whole crude oils, and other media in heat transfer equipment. Estimates of the costs associated with exchanger fouling are in the billions of dollars per year for the petroleum refining industry. While there are many types of refinery equipment affected by fouling, more recent cost estimates have shown that the majority of profit losses occur due to the fouling of whole crude oils and blends in the exchangers of the preheat trains preceding crude units.

While heat exchanger fouling can occur by different mechanisms, one of the more common root causes is asphaltene precipitation and adherence of the precipitates at hot surfaces. To return the unit to more profitable levels, such fouled heat exchangers typically need to be removed from service and cleaned.

The current approach to clean fouled heat exchangers involves isolating the exchanger for cleaning off-line. This is typically performed once the exchanger's efficiency is reduced to non-profitable levels as a result of the coke build up. Coke is a fouling product that is difficult to remove from surfaces by chemical means due to its insolubility in many solvents. To carry out the cleaning, the exchanger is first drained and the coke deposits removed by mechanical typically using brushes or darts to remove the deposits although alternatives such as by liquid lancing with high pressure jets or with abrasive liquids or by blasting with solid carbon dioxide have been explored but all these expedients have the same disadvantage, that the exchanger has to be taken off-line to be drained so as to obtain access to the open ends of the tubes in the tube header. So, regardless of the actual technique used to remove the fouling from the tubes, there is a major loss from the down time resulting from the loss of use of the equipment as well as from the necessity to have to re-route the process liquid to other exchangers so as to allow permit continued heating of the process fluid and operation of the process unit. It would, therefore be desirable to devise a method which will reduce or eliminate the need to physically remove and clean affected heat exchangers.

SUMMARY OF THE INVENTION

We have now devised a method to remove precipitated/adhered asphaltenes from heated surfaces of heat exchange equipment before these asphaltenes become thermally degraded and converted to coke. The method is based on the recognition that the coking mechanism requires both temperature and time and that if it is possible to re-dissolve the asphaltenes before they are converted fully to coke, the equipment can be effectively cleaned by non-mechanical means. We have found selected crude oils, or other petroleum refinery streams that have higher solvent power for asphaltenes than the blends or oils from which they precipitated. These streams may be used to remove the precipitated asphaltenes from the exchanger surfaces before solid, adherent coke deposits can be formed. It is possible to achieve this re-dissolution of the asphaltenes while keeping the exchanger connected to the process unit and thereby reduce or eliminate the need to physically remove and clean the exchanger.

The method according to the present invention for cleaning heat exchangers is applicable to cleaning asphaltene deposits from the heating surfaces of heat exchangers. It functions by using an oil solvent of specific, high solvent power to dissolve the asphaltenes before they are converted over time by continual exposure to heat to coke deposits on the heating surfaces. The dissolved material can be recovered from the stream of cleaning oil and processed in the refinery using conventional refining operations.

The present cleaning method is directly applicable to use with heat exchangers in which high temperatures are encountered in the processing of petroleum streams, especially whole crudes, reduced crudes and heavy hydrocarbon fractions produced in petroleum refinery operations which are likely to contain asphaltenes subject to precipitation during processing. Fractions which typically contain asphaltenes include, for example, atmospheric resids, vacuum resids, heavy atmospheric gas oils, heavy vacuum gas oils, heavy cycle oils, deasphalted oils and aromatic extract streams. The present cleaning method is, however, also applicable to heat exchangers used with various other streams which may tend to precipitate other fouling deposits upon prolonged exposure to heat, for example, streams which contain high molecular weight naphthenic compounds and even high molecular weight paraffins, e.g. waxes. The solvent may be selected to have good solvency for paraffin waxes as well as asphaltenes and for this reason, the present cleaning method is of wide utility in petroleum refineries and petrochemical plants.

The cleaning method operates, as noted above, without taking the heat exchanger off-line, that is, without physically disconnecting the exchanger from the process unit in which it is used. It is therefore useful in operations where cleaning is frequently needed, e.g. with tube-and-shell exchangers in high temperature operation with heavy oils, but it can also be used with heat exchangers whose constructions do not lend themselves to cleaning by mechanical means, for example, to U-type tube-and-shell exchangers and to plate type exchangers, particularly of welded or brazed-up plate type and to spiral exchangers. Thus, the present cleaning method may enable the applicability of exchangers of these types to fields from which they have presently been excluded because of the difficulties associated with cleaning them. With a tube-and-shell type exchanger, cleaning is normally necessary mostly on the tube side i.e. inside the tubes on the side carrying the process fluid which causes the fouling when heated, and it is in this application that the present cleaning method has its prime utility but if shell side cleaning is required, the method may be so extended. With exchangers of other types, for example, plate or spiral type exchangers, the present cleaning method may be used if fouling from asphaltenic process fluids is a problem and in such cases, the method will be applied to the side subject to the fouling.

By enabling the exchangers to be cleaned on-line, simply by the use of an appropriate solvent, it may be possible to achieve a significant reduction in operating costs since the down-time is reduced as well as the requirement for the labor-intensive tasks of disconnecting the exchanger, removing casing and head assemblies, carrying out mechanical cleaning operations and restoration to operational status. In addition, run lengths for the unit may be extended by this convenient cleaning practice.

In practice, the heat exchangers are cleaned on-line by the use of the high solvent power (HSP) oil. The oil is admitted to the exchanger and allowed to soak the exchanger surfaces for a sufficient period of time to dissolve the asphaltenes, after which the oil is removed with the dissolved asphaltenes, together with any loosened solid deposits, and recovered and processed in the refinery by conventional refining operations, e.g. by sending to the coker. The method is particularly useful with the preheat exchangers in crude units and distillation units and in such applications, the preheat train is treated with the solvent oil which is then left to soak to remove the precipitated asphaltenes.

DETAILED DESCRIPTION

Petroleum oils differ in their capability to dissolve the troublesome asphaltenes and other components of crude oils which may lead to fouling deposits. In general terms, oils of a paraffinic character will be the most effective at removing the waxy components while oils with a greater proportion of ring compounds (naphthenics but also aromatics) will be the most effective for dissolving asphaltenes. Depending upon the composition of the process liquid, therefore, it is desirable to select the solvent(s) with properties that enable dissolution of the foulant precursors which are likely to be present in the exchanger.

The present exchanger cleaning method is particularly useful with exchangers which are used in the processing of high-asphaltenic crude oils which can precipitate asphaltenes during exposure to higher temperatures initially forming a sludge-like material; with these sludges, the high solvent power solvents with a high solvent blending number (SBN) value should be used for most effective removal of the sludge.

A suitable measure of the effectiveness of a petroleum solvent oil is its Solubility Blending Number (SBN). Oils with a high SBN, typically 80 or higher and preferably 100 or higher, will be highly effective in dissolving asphaltene precipitates. Thus, solvent oils with an SBN above 80, preferably above 100, will normally be found to be generally useful as solvents. Oils with an SBN below 80 are, however, by no means to be excluded as they may be useful in cleaning exchangers used with paraffinic crudes.

The Solvent Blending Number, SBN, is a parameter relating to the compatibility of an oil with different proportions of a model solvent mixture such as toluene/n-heptane. The Solubility Blending Number is related to another parameter, the Insolubility Number, In, determined in a similar manner and related as set out in U.S. Pat. No. 5,871,6341. See also "The Oil Compatibility Model and Crude Oil Incompatibility", *Proceedings of the First International Conference on Petroleum Phase Behavior and Fouling*, ed. by I. A. Wiehe, AIChE, New York, pp. 82-87 (1999) and I. A. Wiehe and R. J. Kennedy, "The Oil Compatibility Model and Crude Oil Incompatibility", *Energy & Fuels,* 14, 56-59 (2000). The values of SBN and in referred to in this specification are those determined by the method described in U.S. Pat. No. 5,871,634.

The values of SBN can vary over a wide range from low values typically in the range of 30-40 for light paraffinic fractions such as diesel oil and kerosene to highs of over 110, reflecting an aromatic composition with significant content of two- and three-ring aromatics and cycloparaffins (naphthenes). The relatively high aromatic fractions such as coker gas oils, cycle oils that have high SBN values of 100 or more may be used as effective solvents for precipitated asphaltenes and, accordingly, may be used as solvents in the present cleaning method. The solvent may also be composed wholly or partly of a crude or reduced crude of appropriate HSP value, especially an asphaltenic crude, which contains a significant proportion of high boiling components of aromatic character and which will confer a high SBN on the oil. Whole or reduced crudes with an SBN of 100 or more are the most effective although SBN values down to as low as 80 will also be useful. One or more of the lighter refined fractions with an appropriate SBN may be blended with the crude or reduced crude but since the crude is likely to be the cheapest oil which is also effective, a crude, optionally with a minor amount of a refined fraction will normally be preferred. If a refined fraction is used, the amount of the co-blended fraction will usually not exceed one half the total amount of solvent, by volume, and in most cases, not more than 25 percent by volume of the cleaning oil. Blending should be carried out so as to maintain the desired SBN for the final blend, preferably above 100 as noted above.

The Insolubility Number ($I_n$) of the solvent oil is not normally a significant factor since it is the solvent power, as measured by the SBN, which is significant for dissolving the asphaltenes. Oils with Insolubility Numbers above about 50 such as resids are, however, less preferred as solvents in view of their tendency to precipitate asphaltenes. $I_n$ values below about 30 are very satisfactory in most circumstances.

While dissolution of the asphaltenes may be readily effected at warm ambient temperatures, e.g. 25° C., heating the solvent, for example, to temperatures of 45° or 50° C. or higher will assist dissolution of the asphaltenic coke precursors. When the exchanger is at the operating process temperature from on-line service, e.g. at temperatures from about 50° to 200° C. (about 120° to 390° F.), depending upon the service conditions, the solvent will be warmed upon admission to the exchanger and dissolution of the asphaltenes will be facilitated even though the temperature of the exchanger and the solvent in it will decline towards ambient temperature with increasing time. If, however, the exchanger has been taken off-line or operation has been interrupted, the exchanger can be warmed by admitting hot fluid to the shell side to warm the solvent and facilitate dissolution of the asphaltenes; if equipment configuration permits, the solvent oil may be circulated in a closed pump-around loop, preferably with external warming, during the soak period to promote faster dissolution of the asphaltenes.

After the precipitated asphaltenes have been sufficiently taken up into solution, or at least dissolved to the extent feasible, the solution of dissolved asphaltenes can be withdrawn from the exchanger and sent for processing in the refinery. Soak time is typically at least 24 hours but longer periods may be used to advantage, for example at least 48 hours or even 72 hours or more. After withdrawal from the exchanger, the solvent-extracted mixture can be recovered by blending into the feed for the crude unit. If, however, a large portion of a refined fraction is used as the solvent, the solvent-extracted mixture can be sent to the unit which conventionally handles that fraction, after making due allowance for the dissolved asphaltenes. Refined fractions used as solvents may be recovered in an appropriate fractionator.

Dissolution of precipitated asphaltenes in the solvent oil and removal from the heat exchanger surfaces will be effective to prevent thermal degradation of these asphaltenes in the exchanger and the formation of coke from them on the exchanger surfaces. The solvent may also be effective to remove some coke particles and/or agglomerates which may be bound together with non-coke type materials such as trapped oil and soluble asphaltenes; these may be taken up by the solvent oil, enabling the particles and/or agglomerants to be removed as a suspension in the solvent.

Example 1

Solvent Evaluation

Several refinery side-streams and a whole crude were evaluated for their potential as High Solvent Power feeds. These streams are listed in the table below with density and measured compatibility data.

| Feed | SBN | In |
|---|---|---|
| Heavy Solvent Neutral Oil | 139 | 0 |
| Light Gas Oil (Virgin Diesel) | 37 | 0 |
| Bright Stock | 98 | 0 |
| Bright Stock Extract | 98 | 0 |
| Light Cat Heating Oil (LCHO) | 110 | 0 |
| Heavy Cat Heating Oil (HCHO) | 139 | 0 |
| Heavy Cycle Gas Oil (HCGO) | 139 | 0 |

-continued

| Feed | SBN | In |
|---|---|---|
| Heavy Aromatic Fuel Oil (HAFO) | 189 | 102 |
| Topacio (Equatorial Guinea) Crude | 109 | |
| Alba (North Sea) whole crude oil | 158 | |
| Lokele (Cameroon) whole crude oil | 118 | |
| BCF-22 (Venezuela) whole crude oil | 100 | |
| SJV (California) whole crude oil | 125 | |
| Chad Blend crude oil | 112 | |
| Escalante (Argentina) whole crude oil | 132 | |
| Balder (North Sea) whole crude oil | 124 | |
| Harding (North Sea) whole crude oil | 117 | |

LCHO: Light catalytic cracking heating oil, mostly two-ring aromatics
HCHO: Heavy catalytic cracking heating oil - two- and three-ring aromatics
HCGO: Heavy cycle gas oil - three- and four-ring aromatics
HAFO: Heavy aromatic fuel oil - catalytic cracker slurry oil

Example 2

Field Testing Results

As the final step prior to a crude unit shutdown at a refinery, a solvent blend of at least 90 percent by volume of an HSP (SBN 109) crude was charged into the preheat train of a refinery crude unit and allowed to soak for a few days to dissolve deposited, otherwise insoluble foulant precursors (asphaltenes). The temperature in the exchangers of the train initially corresponded to the operating temperature of the exchanger, depending on its location in the train, from about 40° to 210° C. (about 100° to 400° F.), declining to about 40° C. (about 100° F.) for the entire train as the unit cooled to near ambient conditions.

A devoted storage tank containing the solvent blend was charged to the crude unit as it slowed for the downtime; the HSP blend was used also used for the final flush-out of the unit following the soaking period.

On return of the unit to service it was found that as a result of using the HSP crude oil solvent during the soak, the energy efficiency of the preheat train exchangers was improved by approximately 15 kbtu/bbl (about 100 kJ/liter) on average. In addition to the energy benefits observed, the inlet temperature of the crude unit desalter improved to the highest observed over the pervious year. Also, a lower furnace firing intensity was experienced than during record crude runs earlier in the year. These benefits allowed the unit to process greater amounts of crude and at greater efficiency.

It will be apparent to those skilled in the art that various modifications and/or variations may be made without departing from the scope of the present invention. It is intended that the present invention covers the modifications and variations of the method herein, provided they come within the scope of the appended claims and their equivalents.

What is claimed is:

1. A method of cleaning heat exchange surfaces of a heat exchanger, wherein the heat exchanger is part of a refinery process unit, wherein the heat exchanger is being used to adjust a temperature of a process fluid flowing therethrough, wherein the process fluid comprising asphaltenic compounds, wherein at least a portion of the asphaltenic compounds have precipitated out of the process fluid onto the heat exchange surfaces, wherein the method comprising:

soaking at least one of the heat exchange surfaces of the heat exchanger with an oil solvent having a Solubility Blending Number (SBN) of at least 80 to dissolve asphaltenic compounds precipitated from the process fluid in the oil solvent, wherein the oil solvent comprises at least fifty percent by volume of a crude oil with a Solubility Blending Number of at least 100 and the remainder of the oil solvent comprising a fraction, wherein the oil solvent is at a temperature of at least 25° C. when in contact with at least one of the heat exchange surfaces of the heat exchanger;

removing the oil solvent with dissolved asphaltenic compounds from the heat exchanger; and processing the oil solvent with dissolved asphaltenic compounds in the refinery process unit.

2. The method according to claim 1, wherein the crude oil has a Solubility Blending Number of 100 to 120.

3. The method according to claim 1, wherein the oil solvent comprises at least 50 percent by volume of a crude oil having an SBN of at least 100, the remainder of the oil solvent comprising a fraction having an SBN of at least 100.

4. The method according to claim 3, wherein the oil solvent comprises at least 75 percent by volume of a crude oil having an SBN of at least 100.

5. A method of cleaning heat exchange surfaces on a tube side of a shell-and-tube type heat exchanger, wherein the heat exchanger is being used to adjust a temperature on a tube side petroleum process fluid, wherein the petroleum process fluid comprising asphaltenic compounds, wherein at least a portion of the asphaltenic compounds have precipitated out of the process fluid onto the heat exchange surfaces, wherein the heat exchanger is part of a refinery process unit, wherein the cleaning of heat exchange surfaces occurs without disconnecting the heat exchanger from the process unit, the method comprising:

removing process fluid from the tube side of the heat exchanger;

soaking the heat exchange surfaces of the tube side of the exchanger with an oil solvent having a Solubility Blending Number (SBN) of at least 80 to dissolve asphaltenic compounds precipitated from the process fluid on the heat exchange surfaces in the oil solvent, wherein the oil solvent comprises at least fifty percent by volume of a crude oil with a Solubility Blending Number of at least 100 and the remainder of the oil solvent comprising a fraction;

removing the oil solvent with dissolved asphaltenic compounds from the heat exchanger; and processing the oil solvent with dissolved asphaltenic compounds in the refinery process unit.

6. The method according to claim 5, wherein the crude oil has an SBN of 100 to 120.

7. The method according to claim 5, wherein the oil solvent comprises at least 50 percent by volume of a crude oil having an SBN of at least 100, the remainder of the oil solvent comprising a fraction having an SBN of at least 100.

8. The method according to claim 5, wherein the oil solvent is at a temperature of at least 25° C. when in contact with the heat exchange surface of the heat exchanger.

9. The method according to claim 5, wherein the petroleum process fluid comprises a whole crude oil or a reduced crude oil.

10. The method according to claim 5, wherein the oil solvent is contacted with the heat exchange surfaces for at least 24 hours.

11. The method according to claim 5 in which the oil solvent is contacted with the heat exchange surfaces for at least 48 hours.

12. The method according to claim 7, wherein the oil solvent comprises at least 75 percent by volume of a crude oil having an SBN of at least 100.

* * * * *